United States Patent [19]

Pool

[11] 4,201,018

[45] May 6, 1980

[54] CABBING DEVICE FOR GEMSTONES

[76] Inventor: Clarence Pool, 8321 Passons Blvd., Pico Rivera, Calif. 90660

[21] Appl. No.: 953,643

[22] Filed: Oct. 23, 1978

[51] Int. Cl.[2] ..... B24B 9/16

[52] U.S. Cl. ..... 51/229

[58] Field of Search ..... 51/229, 234, 96, 124 R; 279/41, 41 A

[56] References Cited

U.S. PATENT DOCUMENTS

| | | | |
|---|---|---|---|
| 1,605,142 | 11/1926 | Redinger | 279/41 |
| 2,735,246 | 2/1956 | Ponting | 51/229 |
| 2,982,058 | 5/1961 | Maitenaz | 51/124 R |
| 3,439,456 | 4/1969 | Bailey | 51/229 |
| 3,449,198 | 6/1969 | Spragg | 51/234 |
| 3,468,067 | 9/1969 | Larson | 51/96 |
| 3,688,452 | 9/1972 | Stevens | 51/229 |
| 3,849,945 | 11/1974 | Lindzy | 51/229 |
| 4,010,577 | 3/1977 | Henry | 51/229 |

FOREIGN PATENT DOCUMENTS

| | | | |
|---|---|---|---|
| 10968 | 7/1890 | United Kingdom | 279/41 |

*Primary Examiner*—Harold D. Whitehead
*Attorney, Agent, or Firm*—William H. Maxwell

[57] ABSTRACT

A machine device for generating a convex surface, especially for the formation of the front surface of a cabochon, inherently symmetrical without irregularities and in a range of sizes both spheroid and ovoid, and comprising a manually operable dop-stick to which workpieces are replaceably attached to be shaped about two selectively distinct radii, by advanceably offering the workpieces into grinding engagement with an abrasive wheel.

16 Claims, 9 Drawing Figures

CABBING DEVICE FOR GEMSTONES

BACKGROUND

The shaping of gemstones is akin to the shaping of optical lenses and is the work of the lapidarist who employes methods of grinding, sanding and polishing. More particularly, the shaping of a cabochon is akin to the shaping of an anastigmatic lens, a lens having an ovoid surface. Accordingly, the prior art practice of grinding such lenses, for example corrective lenses for eye glasses, has evolved from a rather simple arrangement of longitudinally offset axes to the present day refinement involving laterally offset axes and a complex of machinery for simultaneously generating ground surfaces about two right angularly related axes adjustably offset with respect to each other. The ovoid surface of such a lens is not so pronounced as that of a cabochon, however the principles of grinding are the same. And, though attempts have been made to mechanize the grinding of cabochons, they have been wanting in many respects because with simplification the desirable wide ranges of adjustment have been lost or sacrificed. Therefore it is a general object of this invention to provide a simple and yet practical cabochon generating device which has a wide range of selective adjustment. That is, a large number of different curvature relationships are generated thereby.

In the past, cabbing has involved the manipulation of a dop-stick to which the rough gemstone is dopped or attached, the configuration of the cabochon being entirely dependent upon the expertise of the artisan. Consequently, such cabochons vary widely in shape and are most often imperfect to some extent, in that they are seldom a true spheroid or ovoid. That is, inspection will show that a hand fashioned cabochon is asymmetrical to some extent and exhibits irregularities. Therefore, it is an object of this invention to provide a device for ensuring symmetry in a cabochon and to virtually eliminate surface irregularities.

A cabochon or "cab" is a flattened gemstone usually of oval form and having at least one convex side. Optimum convex curvature is uniformly developed about two right angularly related axes, presenting a symmetrical ovoid surface. Heretofore, ovoid lens surfaces have been generated by machines comprised of infinitely adjustable levers pivotally carrying the workpiece to be cut about two offset axes, the offset being infinitely adjustable as well. Such machines are complex in order to discriminately arrive at precise optical values. Applicant has observed that the principle of offset right angularly related axes about which levers of different radii control the surface contours of lens grinding is applicable to the generation of cabochons having the same geometric form, a convex spheroid or ovoid surface. Accordingly, it is an object of this invention to provide a simplified machine device having a positive rule of action replacing the manipulation of a dop-stick by an artisan, and to produce symmetrical cabochons without irregularities.

The truncation of the ovoid surface determines the plan form of the cabochon, and therefore it is desirable that the ovoid surface be true, otherwise the said plan form will not be a true circle or oval form. In other words, odd egg shapes and pear shapes are to be avoided. However, the ovoid proportions can vary widely with respect to the curvatures about the major and minor axes thereof, and accordingly it is an object of this invention to provide a wide range of pre-determined incremental relationships between the major and minor axis curvatures. With the present invention, both the major and minor curvatures and the offset relationship of the two axes are incrementally adjustable, and with the embodiment shown seventeen distinctly different cabs are produced as hereinafter shown and described.

The classic cabochon is of oval plan form configuration, however they are also formed as rounds, squares, polygons and random shapes. In all cases however a perfect convex surface is highly desirable, without undercuts and/or irregularities. Therefore, it is the convex surface with which this invention is concerned, and in practice several basic spherical surfaces are generated, as well as a number of ovoid surfaces. Therefore, there are instances where the two axes of generation intersect right angularly, and there are also instances where they are offset so as to generate the major and minor axes of the cabochon surface. It is the placement of axes with which this invention is particularly concerned, seventeen distinct cabochon configurations being generated with five incrementally spaced pivot openings in the dop-head arm and four incrementally spaced pivot openings on the pivot hub which advanceably offers the workpiece forwardly into cutting engagement with an abrasive wheel. Selective adjustment of the dop-head arm simultaneously determines the radii from said two axes of rotation. Basically, there is an advanceably movable vertical axis about which the major axis of the cabochon is generated, and there is an incrementally adjustable horizontal axis about which the minor axis of the cabochon is generated.

The art of shaping a cab involves "dopping" the rough stone onto the head end of a stick, and in the present machine to an arm. Such a stick is manipulated and fashioned in different manners to suit the artisan while the present arm is a permanent part of the machine. Further, the artisan working with the classic dop-stick and with the instant machine device can advantageously progress from the use of the dop-stick to said machine device. Furthermore, the artisan most often works upon a large number of art pieces or projects, so that interchangeability is highly desirable. Therefore, it is an object of this invention to provide replaceable dop-heads keyed to the dop-head arm of the present machine for exact positioning thereon, said dop-heads being replaceable at the active end of both a dop-stick and said dop-head arm of the machine. In practice, the replaceable dop-heads are fashioned to the standarized oval configuration plan forms of the cabs to be shaped, in two basic sizes.

The machine device of the present invention is primarily useful in the production of conventional cabochons wherein the major radius of curvature extends across the major axis of the oval form, and wherein the minor radius extends across the minor axis. Accordingly, the minor axis pivot is offset forwardly from the major axis pivot while the minor axis of the cab form parallels the major axis pivot, and the major axis of the cab form parallels the minor axis pivot. However, it is an object of this invention to create an inovation wherein the above described convention is reversed, so that the larger curvature extends transversely and the shorter curvature extends longitudinally of the cab oval. Accordingly, the pivot of this machine device is reversible so that the major axis pivot is offset rearwardly from the minor axis pivot while the major and minor axes of the cab form remain in the same rotative position keyed by the aforementioned cab head to the dop-head arm.

SUMMARY OF INVENTION

This invention relates primarily to the shaping of gemstones into cabochons, by controlling the motion thereof when offered up to a grinding wheel. Any one of a number of cabochon configurations can be generated by the machine device herein disclosed, by selective positioning of the dop-head thereof, to vary both of the two axes thereof and the relationship therebetween as well. Generally, there is a base B which carries a shiftable standard S which is disposed to swing through a vertical plane in alignment with the turning plane of an abrasive wheel W. The standard features a cylindrical pivot 10 over which a vertical pivot hub H revolves freely with light friction. Spaced above the base and in horizontal alignment with the axis of wheel W, the pivot hub H carries a series of incrementally spaced transverse pivot openings 11 to mount the dop-head arm D by means of a removable pivot pin P, there being a series of incrementally spaced transverse pivot openings 12 through said dop-head arm D to receive said pins with light friction. The extended terminal end of the dop-head arm carries replaceable dop-heads A for the attachment of workpieces in the form of rough stones to be shaped into cabochons of selected configuration within the adjustment range of the device, as will be described.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
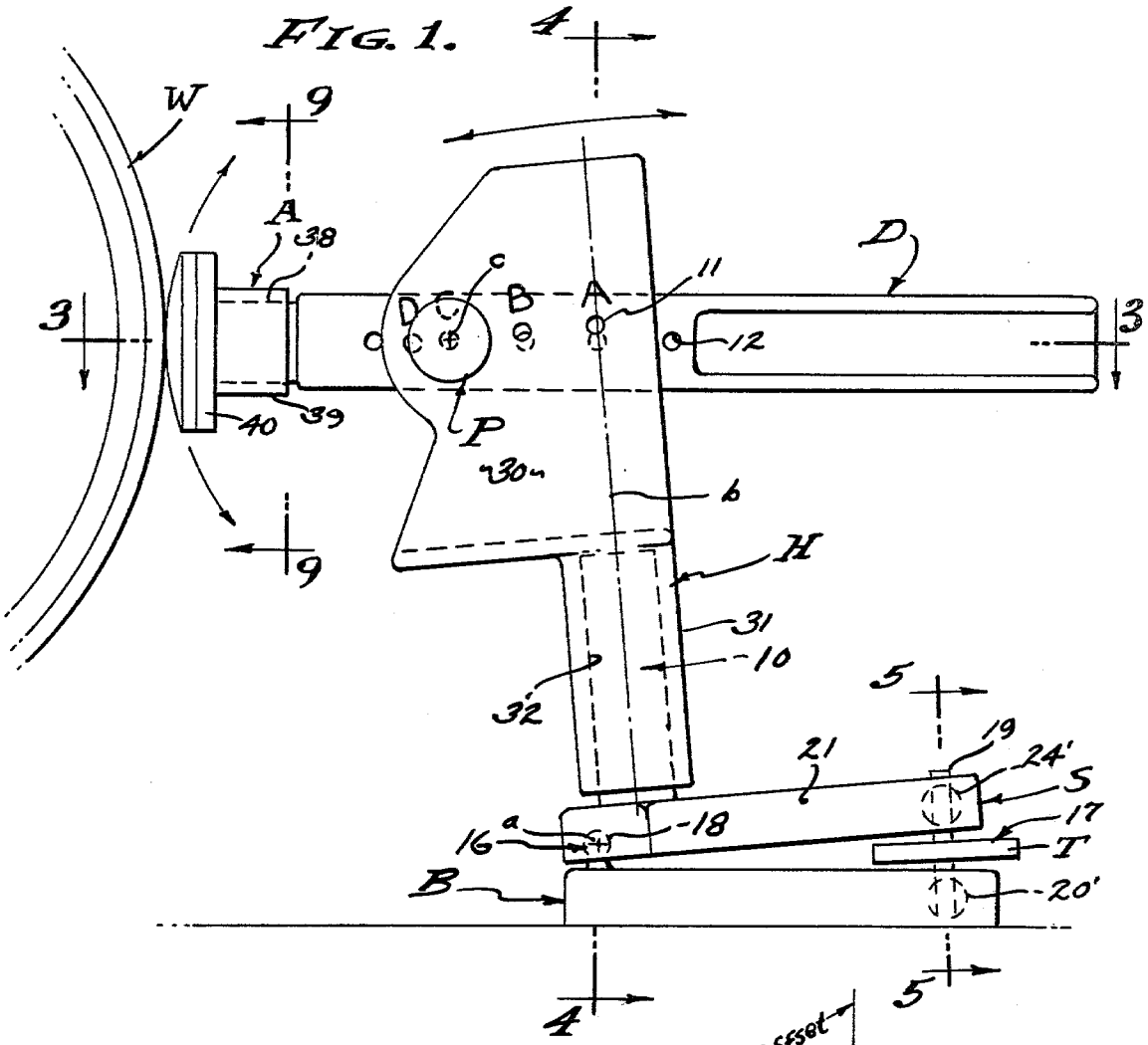
FIG. 1 is a side elevation of the present invention as it applies a cabochon to a grinding wheel.

Referring now to the drawings, the machine device of the present invention is embodied in pressure molded plastic such as Delrin as manufactured by DuPont, with pivot and screw members of metal molded therein and/or carried thereby as will be described. The base B is adapted to be supported upon a planar surface that supports a grinder having a wheel W into which the rough stone is offered to be shaped according to predicted movements governed by the device. In practice, the dop-head A carried by the dop-head arm D has a normally horizontal position in alignment with the center plane of wheel W and intersecting the axis of rotation of said wheel. It is to be understood that there are various types of grinding wheels and discs, to which this machine device is similarly applied. The operating person faces the grinder with the device disposed so that a face of the rough stone workpiece carried by the dop-stick D is juxtaposed to the grinding surface of the wheel W.

The base B is a flat horizontal member with openings (not shown) to receive fasteners for securement to a supporting surface, as may be required. In practice, the base is substantially square with pivot means 16 at its front edge closest to wheel W, and with adjustment means 17 at its rear edge closest to the operator. The pivot means 16 comprises a pair of at least two spaced balls 18 standing above the top surface of the base at the front edge thereof and centered on a transverse adjustment axis a parallel to the supporting surface and axis of the grinder. The adjustment means 17 comprises a double ended screw 19 projecting vertically from the top surface of the base at the rear edge thereof in a center plane midway between the two balls 18. Immediately adjacent the rear edge of the base there is a downwardly faced socket 20 for the reception of a nut 20'. The screw 19 is provided with right and left hand threads at its opposite ends, one end of which is threadedly engaged through the nut 20'. In practice, the nut 20' is a transversely disposed right cylinder that is rotatably captured by the partial occlusion of the socket 20, into which it is snapped by virtue of the resiliency of the plastic material of which the base is formed.

The shiftable standard S overlies the base B to adjustably position its pivot 10, being of bellcrank formation with the axis b of pivot 10 normal to a platform 21 that extends between the front and rear edges of the base. The aforementioned pivot means 16 is received by partially occluded spherical sockets 22 that are complementary to and which snap over the balls 18, by virtue of the resiliency of the plastic material of which the platform is formed. And the other end of the aforementioned adjustment means 17 screw 19 is threadedly engaged through a nut 24' in said platform. In alignment with the above described socket 20 there is a downwardly faced socket 24 in the platform, and in practice the nut 24' is a transversely disposed right cylinder that is rotatably captured by the partial occlusion of the socket 24 into which it is snapped by virtue of the resiliency of the plastic material of which the platform is formed. Control over the forward swinging revolvement of axis b is by means of a thumb-wheel T notched into the platform 21 and turning the screw 19 to elevate the rear edge of said platform 21 as required. A feature is the pivot 10 which is preferably a right cylinder member of metal molded permanently into the platform 21 to project therefrom for support of the hub H next to be described.

In accordance with this invention, the hub H provides for selective positioning of a horizontal axis c at a right angle to axis b and intersecting the same or spaced incrementally therefrom as may be required, thereby to carry the dop-head arm D swivelly about two distinct axes b and c. In practice, there are three distinct pivot openings 11 positioned as designated by "A", "B" and "C" spaced at and incrementally from the axis b, for example in one half inch increments with the designated "A" axis intersecting the said axis b. The openings designated "B" and "C" are spaced forwardly from the axis b; and additionally there is a half increment "C".

The hub H is comprised of a pair of spaced and parallel cheek plates 30 embracing the center vertical plane to pass the dop-head arm D therebetween, and as shown the cheek plates are integral with a hub body 31 having a central bore 32 rotatable over the pivot 10; a blind bore stopped upon the normal top end of pivot 10. Accordingly, the designated positions, "A-D" of axis c are rotatably disposed about the axis b and maintained at a right angle therethrough. In accordance with the generation of conventional cabochons, the dop-head arm D provides for selectively relating the two distinct axis b and c, axis b to control the major radius of the cabochon and axis c to control the minor radius thereof. That is, the major radius about axis b is always equal to or greater than the minor radius about axis c, there being four distinct relationships ("A-D") as shown. However, in order to augment the dimensional relationships of axis b and c, the dop-head arm D is provided with a multiplicity of pivot openings 12 disposed horizontally therethrough with one half inch increments; for example five equally spaced openings 12 parallel one with the other and disposed transversely through the body of the dop-head arm commencing one and one-quarter inch back from the shoulder point of a cabochon to be formed thereby. The pin P is slideably received through the openings 11 and 12 so as to rotatably couple the dop-head arm D to the hub H.

Each selective relationship established by using the axis positions designated "A-D" on hub H are subject to five (5) distinct dimensional relationships. And with the embodiment shown, three (3) dimensional positions are useable for designation "A", four (4) dimensional positions for designation "B", and five (5) dimensional positions for designations "C" and "D". Accordingly in the embodiment shown, there are seventeen (17) different dimensional relationships, and if desired these dimensional relationships can be increased in number and more closely related by increasing the number of axis c openings in hub H, and by increasing the number of increments of selection along the dop-head arm D.

Figure 2:
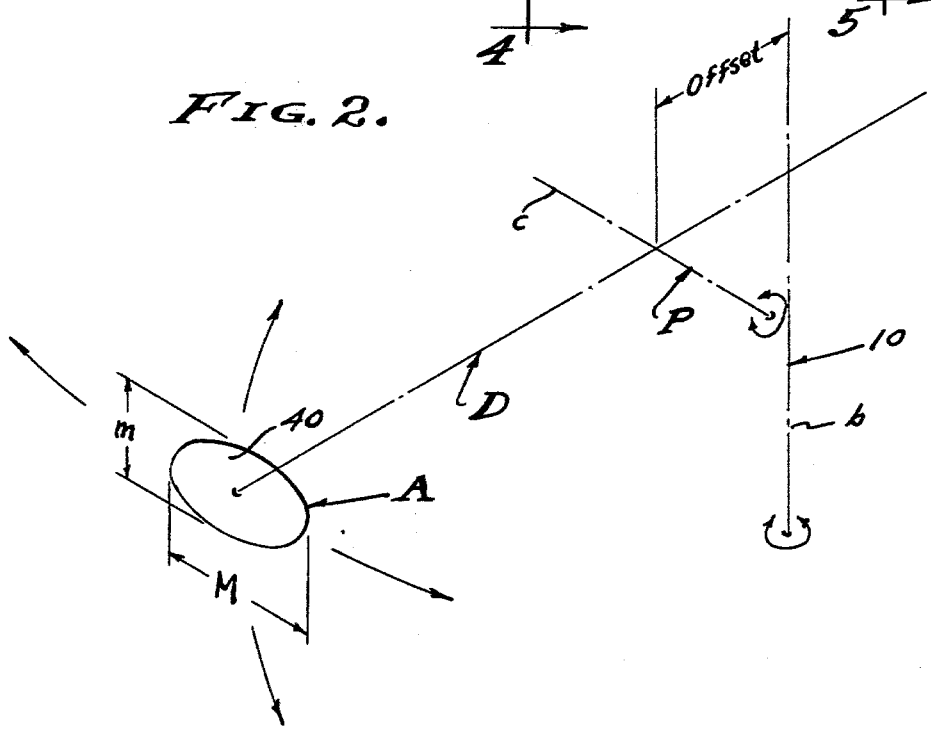
FIG. 2 is a diagramatic view of the articulated and offset axes of the machine device shown in FIG. 1.
Figure 3:
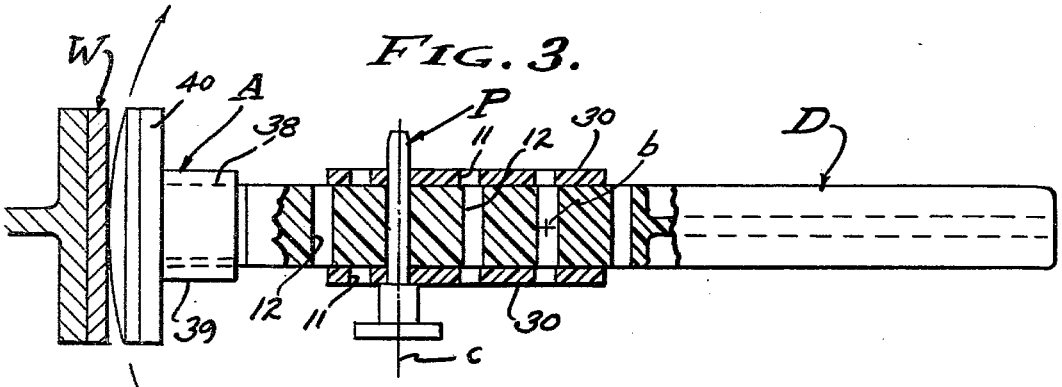
FIG. 3 is a plan section taken as indicated by line 3—3 on FIG. 1.
Figure 4:
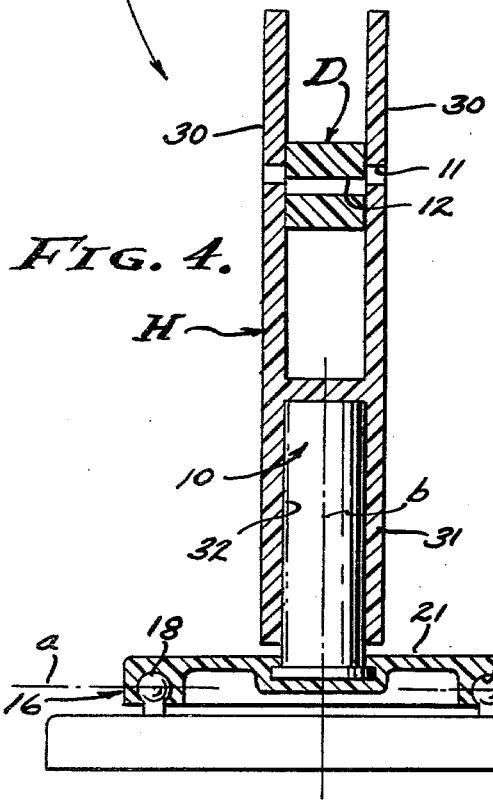
FIG. 4 is a vertical section taken as indicated by line 4—4 on FIG. 1.
Figure 5:
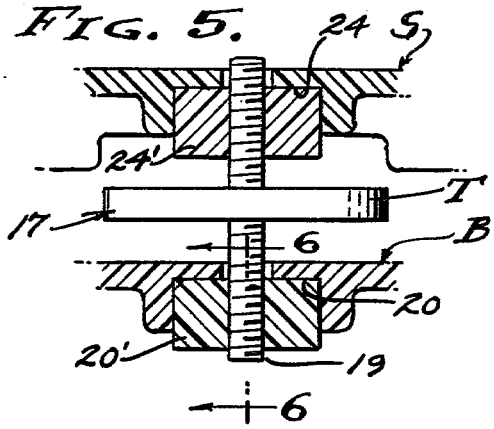
FIG. 5 is an enlarged fragmentary sectional view taken as indicated by line 5—5 on FIG. 1.
Figure 6:
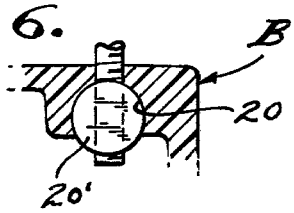
FIG. 6 is a detailed section taken as indicated by line 6—6 on FIG. 5.
Figure 7:
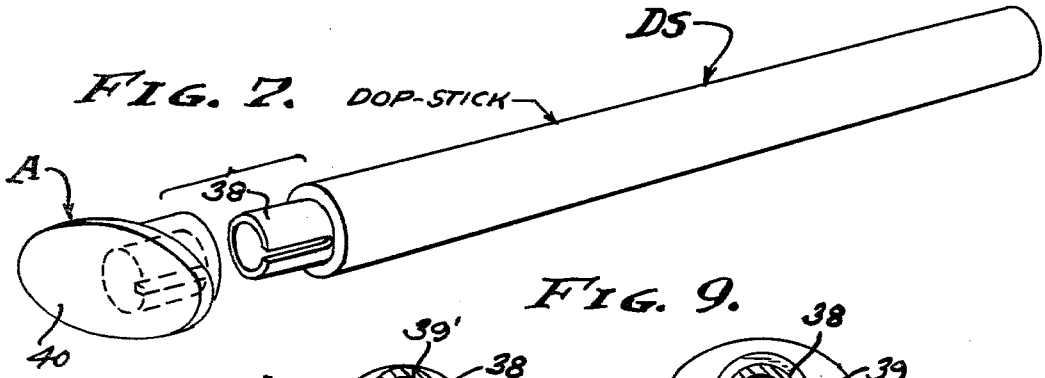
FIG. 7 is an exploded perspective view illustrating the application of the dop-head adapter to a dop-stick.
Figure 8:
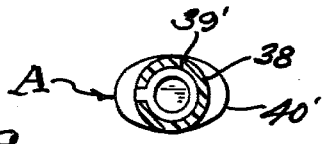
FIG. 8 is a sectional view showing the reception of a smaller sized adapter to a dop-stick or dop-head arm.
Figure 9:
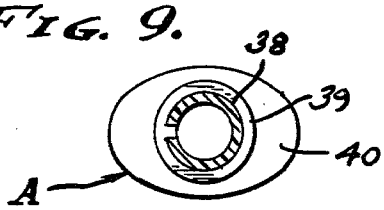
FIG. 9 is a view similar to FIG. 8 and taken as indicated by line 9—9 on FIG. 1 showing a larger sized dop-head adapter applied to the dop-head arm.

The rough stones to be cut or formed are cemented or otherwise applied to the dop-head A, as by using double faced tape, dop wax or any suitable adhesive. As shown in FIG. 7 the dop-head A is of oval configuration, elongated along its major axis M and narrowed along its minor axis m as shown in FIG. 2. The dop-head A is an adapter which comprises a plate 40 normal to the stick or arm axis, the plane thereof being in the configuration of the cabochon size and shape to be formed. A slotted cylinder wall 38 projects forwardly from the stick DS and/or arm D to form a sleeve that slideably receives a keyed member 39 in the form of a socket that carries larger sized plates 40, or receives a plug 39' that carries smaller sized plates 40', and onto which the correspondingly sized rough stones are secured for grinding. FIG. 8 illustrates a dop-head adapter A with a small sized plate 40', in which case the plug member 39' has an external key and is slideably engaged within the slotted cylinder wall 38. FIG. 9 illustrates a dop-head adapter A with a larger sized plate 40, in which case the socket member 39 has an external key and is slideably engaged over the slotted cylinder wall 38.

It will be apparent how the dop-head arm D swings about the selectively related major and minor axes radii, so as to apply the rough stone to the abrasive wheel W in order to generate corresponding curvatures about said two radii. When using axis c position "A" the radii from b and c will be the same and dimensional variation applied by selection of the desired opening 12. However, when using axis c positions "B-D" the radii b and c will be distinct and dimensional variations applied by selection of the openings 12. The dop-head A and attached gemstones can be removed from the dop-head arm D for inspection and replaced for completion and further work thereupon as circumstances require. Further, the dop-stick S is now useable to rough out a cab form preparatory to generating an accurate cabochon in the machine device, utilizing a dop-head A which interchangeably adapts to both a dop-stick S and dop-head arm DS. Furthermore, a multiplicity of rough stones can now be mounted upon individual dop-head adapters without dismantling or changing the dop-head arm D.

The aforementioned inovative form generation of a so-called non-conventional cabochon is accomplished as follows: The hub H is rotated 180° so that the series of openings 11 "A-D" extend rearward from the pivot axis b. Consequently, axis b becomes the minor axis and axis c becomes the major axis. However, said major and minor pivot axes are turned 90° in relation to the major and minor axes of the cabochon to be generated, since the dop-head A is keyed to the forwardly projecting dop-head arm D as above described. Accordingly, the greater curvature is now transverse, and the lesser curvature longitudinal of the oval cabochon form. In the embodiment shown fourteen (14) distinct cabochons can be formed in this manner, each distinct from the aforementioned conventional cabs.

Having described only a typical preferred form and application of my invention, I do not wish to be limited or restricted to the specific details herein set forth, but wish to reserve to myself any modifications or variations that may appear to those skilled in the art as set forth within the limits of the following claims:

I claim:

1. A device for generating the convex surface of a cabochon selectively about two right angularly related axes, by offering the same up to a grinding surface, and including;

a horizontally disposed base centered on a vertical plane before said grinding surface, a standard with means adjustably positioning the same with respect to said grinding surface, and comprised of a platform disposed over the base and a substantially vertical pivot standing upward therefrom to move in said plane toward the grinding surface, a hub free to be revolvably manipulated about the first mentioned pivot and having a horizontal series of transversely disposed pivot openings extending from the first mentioned pivot, and an elongated dop-head arm free to be revolvably manipulated about the second mentioned pivot openings and having a multiplicity of transverse pivot openings in a series extending longitudinally thereof to be individually and selectively aligned with one of said series of pivot openings on the hub, the dop-head arm being coupled a selective position by a replaceable pivot pin, whereby a workpiece carried by a head at the forward extremity thereof swivels about two distinct selected axes of rotation into engagement with the grinding surface to form a compound curvature thereon.

2. The device for generating a cabochon as set forth in claim 1, wherein the base has a pair of balls upstanding therefrom on a transverse horizontal axis at its forward edge and the standard platform has complementary sockets engaged upon said balls respectively for revolvement on said axis, said means adjustably positioning the standard elevating the platform from the base remote from the said axis of revolvement.

3. The device for generating a cabochon as set forth in claim 1, wherein the base has a pair of balls upstanding therefrom on a transverse horizontal axis at its forward edge and the standard platform has complementary sockets engaged upon said balls respectively for revolvement on said axis, said means adjustably positioning the standard comprising a right and left hand screw means threadedly engaging the platform and base to elevate the platform about said axis of revolvement.

4. The device for generating a cabochon as set forth in claim 1, wherein the first mentioned vertical pivot is a right cylinder with a normal top, there being a blind cylinder bore in the head revolvably resting upon said top of the pivot cylinder.

5. The device for generating a cabochon as set forth in claim 1, wherein the series of horizontally disposed pivot openings in the hub extends from the first mentioned pivot and toward the grinding surface.

6. The device for generating a cabochon as set forth in claim 1, wherein the series of horizontally disposed pivot openings in the hub extends from the first mentioned pivot and away from the grinding surface.

7. The device for generating a cabochon as set forth in claim 1, wherein one of the series of horizontally disposed pivot openings in the hub intersects the first mentioned pivot.

8. The device for generating a cabochon as set forth in claim 1, wherein the hub comprises a body revolving upon the first mentioned pivot and a pair of spaced and parallel cheek members carried by the body to embrace the dop-head arm and in which the series of second mentioned pivot openings are formed to receive said pivot pin.

9. The device for generating a cabochon as set forth in claim 1, wherein the hub comprises a body revolving upon the first mentioned pivot and a pair of spaced and parallel cheek members carried by the body to embrace the dop-head arm and in which the series of second mentioned pivot openings are formed to receive said pivot pin, and wherein one of the series of horizontally disposed pivot openings in the hub intersects the first mentioned pivot.

10. The device for generating a cabochon as set forth in claim 1, wherein the base has a pair of balls upstanding therefrom on a transverse horizontal axis at its forward edge and the standard platform has complementary sockets engaged upon said balls respectively for revolvement on said axis, said means adjustably positioning the standard elevating the platform from the base remote from the said axis of revolvement, wherein the first mentioned vertical pivot is a right cylinder with a normal top, there being a blind cylinder bore in the head revolvably resting upon said top of the pivot cylinder, and wherein one of the series of horizontally disposed pivot openings in the hub intersects the first mentioned pivot.

11. The device for generating a cabochon as set forth in claim 1, wherein the base has a pair of balls upstanding therefrom on a transverse horizontal axis at its forward edge and the standard platform has complementary sockets engaged upon said balls respectively for revolvement on said axis, said means adjustably positioning the standard elevating the platfrom from the base remote from the said axis of revolvement, and wherein the hub comprises a body revolving upon the first mentioned pivot and a pair of spaced and parallel cheek members carried by the body to embrace the dop-head arm and in which the series of second mentioned pivot openings are formed to receive said pivot pin.

12. The device for generating a cabochon as set forth in claim 1, wherein the base has a pair of balls upstanding therefrom on a transverse horizontal axis at its forward edge and the standard platform has complementary sockets engaged upon said balls respectively for revolvement on said axis, said means adjustably positioning the standard elevating the platform from the base remote from the said axis of revolvement, wherein the hub comprises a body revolving upon the first mentioned pivot and a pair of spaced and parallel cheek members carried by the body to embrace the dop-head arm and in which the series of second mentioned pivot openings are formed to receive said pivot pin, and wherein one of the series of horizontally disposed pivot openings in the hub intersects the first mentioned pivot.

13. The device for generating a cabochon as set forth in claim 1, wherein the base has a pair of balls upstanding therefrom on a transverse horizontal axis at its forward edge and the standard platform has complementary sockets engaged upon said balls respectively for revolvement on said axis, said means adjustably positioning the standard comprising a right and left hand screw means threadedly engaging the platform and base to elevate the platform about said axis of revolvement, wherein the hub comprises a body revolving upon the first mentioned pivot and a pair of spaced and parallel cheek members carried by the body to embrace the dop-head arm and in which the series of second mentioned pivot openings are formed to receive said pivot pin, and wherein one of the series of horizontally disposed pivot openings in the hub intersects the first mentioned pivot.

14. A replaceable dop-head adapter for alternative positioning upon the controlled end of a manually operable dop-stick in a machine generating a compound convex surface on a rough stone secured to a controlled dop-head arm and offered into engagement with a grinding surface, and including;

a forwardly adjustable standard having a substantially vertical pivot standing upward therefrom to move in a plane toward the grinding surface, a hub free to be revolvably manipulated about the first mentioned pivot and having a horizontal transversely disposed pivot spaced forward of the said first mentioned pivot, whereby the dop-stick and dop-head arm is controlled to swivel about two distinct axes, a slotted sleeve member of cylinder form projecting forwardly from the dop-stick and dop-head arm respectively, an adapter plate having a front face to receive said rough stone to be grounded about distinct axes and disposed normal to the dop-stick and dop-head arm respectively, and a keyed member projecting from the back side of the plate and slideably engaged with said slotted member for rotative positioning of said dop-head adapter thereon, whereby the dop-head adapter is alternatively replaceable upon the controlled ends of said dop-stick and dop-head arm to move the said rough stone about said two distinct axes.

15. The replaceable dop-head adapter as set forth in claim 14, wherein the keyed member projecting from the back side of the plate is internally keyed and slideably engaged over the slotted sleeve member for rotative positioning thereon.

16. The replaceable dop-head adapter as set forth in claim 14, wherein the keyed member projecting from the back side of the plate is externally keyed and slideably engaged within the slotted sleeve member for rotative positioning thereon.

* * * * *